United States Patent [19]

Mollenhoff

[11] 4,146,863

[45] Mar. 27, 1979

[54] ONE-PIECE FUSIBLE CONDUCTOR FOR LOW-VOLTAGE FUSES

[75] Inventor: Klaus Möllenhoff, Regensburg, Fed. Rep. of Germany

[73] Assignee: Siemens Aktiengesellschaft, Munich, Fed. Rep. of Germany

[21] Appl. No.: 773,164

[22] Filed: Mar. 1, 1977

[30] Foreign Application Priority Data

Mar. 11, 1976 [DE] Fed. Rep. of Germany ..... 2610294

[51] Int. Cl.[2] ..... H01H 85/10

[52] U.S. Cl. ..... 337/296; 337/160; 337/163

[58] Field of Search ..... 337/296, 295, 293, 164, 337/163, 161, 160, 166

[56] References Cited

U.S. PATENT DOCUMENTS

| | | | |
|---|---|---|---|
| 2,734,111 | 2/1956 | Kozacka | 337/161 |
| 2,876,312 | 3/1959 | Frederick | 337/163 |
| 3,835,431 | 9/1974 | Rosen et al. | 337/160 |

FOREIGN PATENT DOCUMENTS

| | | | |
|---|---|---|---|
| 1213736 | 11/1970 | United Kingdom | 337/160 |

*Primary Examiner*—Harold Broome

*Attorney, Agent, or Firm*—Kenyon & Kenyon, Reilly, Carr & Chapin

[57] ABSTRACT

A one piece fusible conductor wherein a current carrying isthmus member in the form of a bridge connects first and second members. The first member has a hole in the vicinity of the isthmus and the hole is filled with a rivet shaped solder deposit and defines current carrying regions of the first member leading to the isthmus. In accordance with the invention, the horizontal profile E of the cross section of each of the latter regions is within a range of 0.7 to 1.00mm and the horizontal profile D of the cross section of the isthmus is within a range from 1.0 to 2.00mm. Furthermore, the profiles E and D satisfy approximately the following relationship: $0.75 \geqq E/D \geqq 0.5$.

2 Claims, 1 Drawing Figure

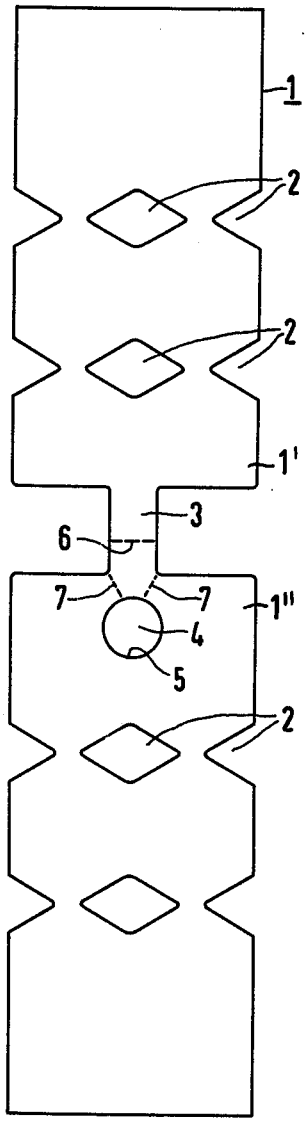
1
2
2
1'
3
6
7
7
1"
4
5
2

ONE-PIECE FUSIBLE CONDUCTOR FOR LOW-VOLTAGE FUSES

BACKGROUND OF THE INVENTION

1. Field of the Invention

The invention relates to one-piece fusible conductors for low-voltage fuses.

2. Description of the Prior Art

Fusible conductors of the above-type are known wherein the conductor has cutouts of substantially equal cross section for narrowing the path of the current. Such conductors also include at least one rivet shaped solder deposit disposed in the vicinity of an isthmus formed in the conductor. The purpose of the isthmus is to respond quickly in the case of an overload, while the other portions of the conductor melt only in the case of a short circuit.

In the design of such conductors the hottest zone is situated close to the solder so that the latter flows quickly into the isthmus during an overload.

It is an object of the present invention to enhance the aforesaid fusible conductors.

SUMMARY OF THE INVENTION

In accordance with the principles of the present invention, the above and other objectives are accomplished in a fusible conductor comprising first and second members having cutouts of equal cross section disposed therein. An isthmus in the form of a bridge is situated between the first and second members and is configured so as to define a current carrying cross section whose horizontal profile D is within a range from 1.0 to 2.00mm. The first member includes a hole in the vicinity of the isthmus and into which is disposed at least one rivet shaped solder deposit. The aforesaid hole defines two current carrying regions of the first member leading to the isthmus and is configured so that the horizontal profile E of the cross section of each region is within a range from 0.70 to 1.00mm and is related to the profile D so as to satisfy approximately the following relationship: $0.75 \geqq E/D \geqq 0.5$.

With the fusible conductor designed as aforesaid, the starting aid for the liquid melting zone is retained, while the hot zone is placed further into the isthmus. As a result, it is ensured that the liquid melting zone can reach the center of the isthmus, and, therefore, that the conductor will sever at the most favorable point without time delay. On the other hand, the danger of aging, as is known from conventional fuses, is avoided, as the alloy formation can reach the isthmus only if the fusible conductor is to interrupt the path of the current.

Brief Description of the Drawing

The above and other features and aspects of the present invention will become more apparent upon reading the following detailed description in conjunction with the accompanying drawing which shows a fusible conductor in accordance with the invention.

Detailed Description

The FIGURE shows a one-piece fusible conductor 1 in accordance with the principles of the present invention. The conductor 1 includes first and second members 1' and 1'', each of which has cutouts 2 of substantially equal cross section. The aforesaid members are joined by a current-carrying isthmus 3 which is in the form of a bridge and which is configured to define a current-carrying cross section 6 whose horizontal profile D is within a range from 1.0 and 2.0mm. The horizontal profile of the cross section 6 is understood to mean the intersection line of the cross section with the plane of the drawing.

The member 1'' is provided with a hole 5 in front of the isthmus 3 which is filled with a rivet shaped solder deposit 4. The hole 5 defines current carrying regions in the member 1'' which lead to the isthmus 3. In particular, the hole 5 is configured so that the horizontal profile E of the cross section 7 of each region is within a range from 0.70 to 1.0mm. Additionally, the isthmus 3 and hole 5 are configured so that horinzontal profiles D and E satisfy approximately the relationship $0.75 \geqq E/D \geqq 0.5$. In a typical case, therefore, D can be 1.4mm and E = 0.7mm.

What is claimed is:

1. A one piece fusible conductor comprising:

first and second members;

a current carrying isthmus connecting said first and second members, said isthmus having end walls which intersect said first member at respective first and second points, said isthmus further having the form of a bridge and defining a current carrying cross section having a horizontal profile D within a range from 1.0 to 2.0mm;

said first member having a hole in the vicinity of said isthmus which defines current carrying regions in said first member leading to said isthmus, each of said regions including one of said first and second intersections points and each having a cross section taken along a line defined by its respective intersection point and the point on said hole substantially closest thereto whose horizontal profile E is within a range from 0.70mm to 1.00mm;

said horizontal profiles D and E being such as to satisfy approximately the relationship $0.75 \geqq E/D \geqq 0.5$;

and at least one rivet shaped solder deposit arranged in said hole.

2. A conductor in accordance with claim 1 wherein said end walls extend longitudinally between said members and said profile D is transverse thereto.

* * * * *